US006928908B1

(12) United States Patent
Yu

(10) Patent No.: US 6,928,908 B1
(45) Date of Patent: Aug. 16, 2005

(54) REVOLVING SCREWDRIVER WITH RATCHET DEVICE

(76) Inventor: Hong-Chow Yu, No. 28, Lane 157, Yong Hsin Rd., Ta-Li City, Taichung (TW)

( * ) Notice: Subject to any disclaimer, the term of this patent is extended or adjusted under 35 U.S.C. 154(b) by 0 days.

(21) Appl. No.: 10/911,809

(22) Filed: Aug. 4, 2004

(51) Int. Cl.[7] ..... B25G 1/08
(52) U.S. Cl. ..... 81/490; 81/177.4; 81/439
(58) Field of Search ..... 81/490, 177.4, 81/439

(56) References Cited

U.S. PATENT DOCUMENTS 5,740,706 A * 4/1998 Tseng ..... 81/490
6,186,031 B1 * 2/2001 Shiao ..... 81/63.1
6,250,185 B1 * 6/2001 Tsung ..... 81/439
6,305,815 B1 * 10/2001 Lin ..... 362/119
6,327,942 B1 * 12/2001 Mariol et al. ..... 81/177.4
6,502,484 B2 * 1/2003 Pao-Hsi ..... 81/439

* cited by examiner

*Primary Examiner*—Joseph J. Hail, III
*Assistant Examiner*—Alvin J Grant
(74) *Attorney, Agent, or Firm*—W. Wayne Liauh

(57) ABSTRACT

A revolving screwdriver comprises a forward ratchet device comprising a hollow, cylindrical seat and a ratchet shaft, and a hollow handle comprising a revolving cylinder including a plurality of axial, peripheral shank cartridges, and a push rod adapted to push the shank out of the cartridge into the ratchet shaft. The ratchet shaft is hollow and comprises a front end having a section of hexagon, a rear end having a section of circle, and a guide in the rear end thereof. The guide is aligned with a flat extended inwardly from the front end of the ratchet shaft such that it can automatically align one shank pushed out of the ratchet cylinder with the forward end of the ratchet shaft prior to pushing the shank out of the ratchet shaft for use.

5 Claims, 15 Drawing Sheets

REVOLVING SCREWDRIVER WITH RATCHET DEVICE

FIELD OF THE INVENTION

The present invention relates to screwdrivers and more particularly to a screwdriver having a revolving cylinder containing a plurality of shank cartridges so that the revolving of the ratchet cylinder will automatically align one shank with a forward bore of the ratchet shaft prior to pushing the shank out of the ratchet shaft for use.

BACKGROUND OF THE INVENTION

A conventional revolving screwdriver as disclosed in Taiwanese Patent Publication No. 90,218,776 is shown in FIGS. 1 to 3. The handle 10 comprises a hollow, cylindrical head 101 having a section of hexagon. The revolving cylinder 11 is provided in an eccentric bore of the handle 10. The revolving cylinder 11 comprises a plurality of axial cartridges 111 on its surface. Each cartridge 111 is capable of receiving one of a plurality of different shanks 12 (i.e., different tips including flat tip, Robertson tip, Phillips tip, etc.) having a hexagonal cross-section. Each cartridge 111 can be aligned with the bore of the head 101 by rotation. An elongated, axial slot 102 is formed on the surface of the handle 10. A slide assembly 13 is adapted to slide along the slot 102. The slide assembly 13 has a lower cavity 131 adapted to matingly engage with the tab 121 at the rear end of the shank 12. The handle 10 further comprises an opening 103 opposite the slot 102. The opening 103 is in communication with the revolving cylinder 11.

As shown in FIGS. 2 and 3 specifically, in use a user may put his/her finger in the opening 103 to contact the revolving cylinder 11 prior to rotating the revolving cylinder 11 until a desired shank 12 is aligned with the bore of the head 101. Next, slide the slide assembly 13 forwardly to push the shank 12 out of the head 101. The user then can hold the handle 10 to turn a screw that is engaged with the tip of the shank 12. As stated above, each of the head 101 and the shank 12 has a section of hexagon. Also, the shank 12 is required to align with the head 101 prior to projecting therefrom for use. Further, the head 101 is fixedly formed on a forward end of the handle 10. Hence, it is easy to align the shank 12 with the head 101 by rotation.

A variety of ratchet screwdrivers are commercially available nowadays. However, the provision of a ratchet device in the revolving screwdriver may encounter a difficulty of aligning the shank 12 with the head 101. This is because the head 101 is provided as a rotary one rather than a fixed one. As such, this type of revolving screwdriver with ratchet device has not enjoyed economic success. Thus, the need for improvement still exists.

SUMMARY OF THE INVENTION

It is an object of the present invention to provide a revolving screwdriver comprising a forward ratchet device comprising a hollow, cylindrical seat and a ratchet shaft; and a hollow handle comprising a revolving cylinder including a plurality of axial, peripheral cartridges for receiving a plurality of hexagonal shanks having different tips, and a push rod adapted to push the shank out of the cartridge into the ratchet shaft; wherein the ratchet shaft is hollow and comprises a front end having a section of hexagon, a rear end having a section of circle, and a guide in the rear end thereof, the guide being aligned with a flat extended inwardly from the hexagonal front end of the ratchet shaft such that it can automatically align one shank pushed out of the ratchet cylinder with the forward end of the ratchet shaft prior to pushing the shank out of the ratchet shaft for use.

In one aspect of the present invention the revolving cylinder comprises a plurality of stages each including a plurality of axial, peripheral cartridges for receiving the plurality of hexagonal shanks having different tips, and wherein each cartridge of one stage is adapted to align with the cartridges of the other stages to form a straight channel. This provides a user with more shank choice.

The above and other objects, features and advantages of the present invention will become apparent from the following detailed description taken with the accompanying drawings.

BRIEF DESCRIPTION OF THE DRAWINGS

FIGS. 10A, 10B, and 10C are sectional views illustrating operations of a guide mounted on a ratchet shaft of the ratchet device according to the invention;

FIGS. 14A, 14B, and 14C schematically depict revolving operations of a shank in the revolving cylinder of FIG. 13.

DETAILED DESCRIPTION OF THE PREFERRED EMBODIMENTS

Figure 1:
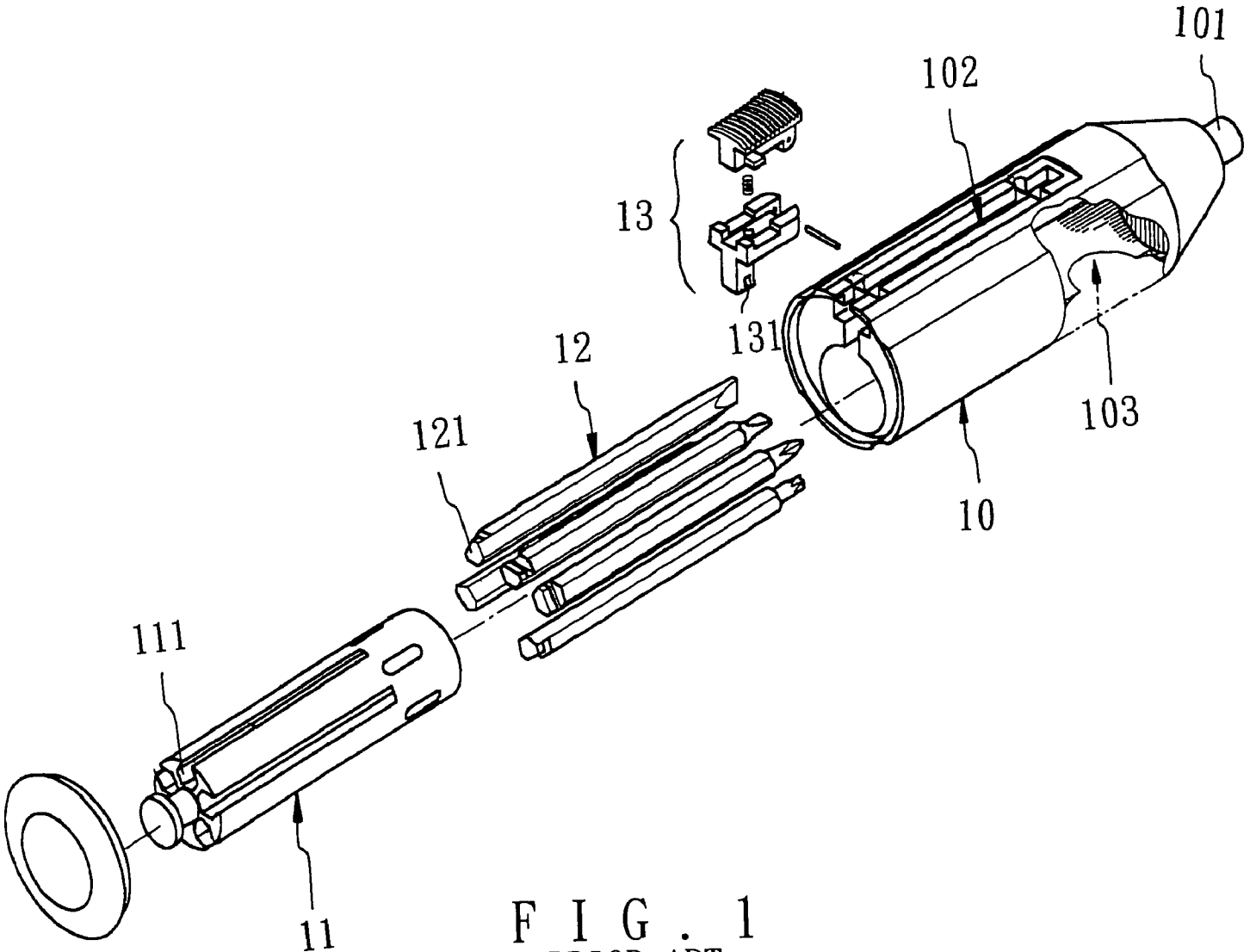
FIG. 1 PRIOR ART
FIG. 1 is an exploded view of a conventional revolving screwdriver.
Figure 2:
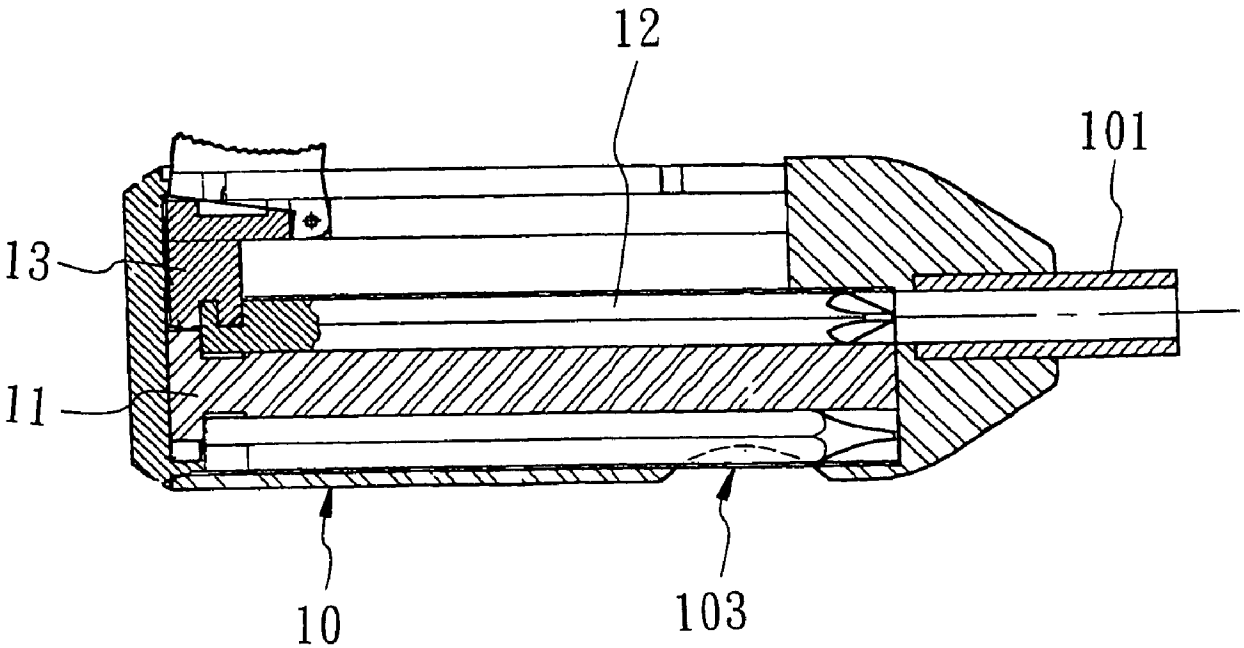
FIG. 2 PRIOR ART
FIG. 2 is a sectional view of the assembled screwdriver of FIG. 1, where one shank is aligned with the bore of the head prior to projecting therefrom for use.
Figure 3:
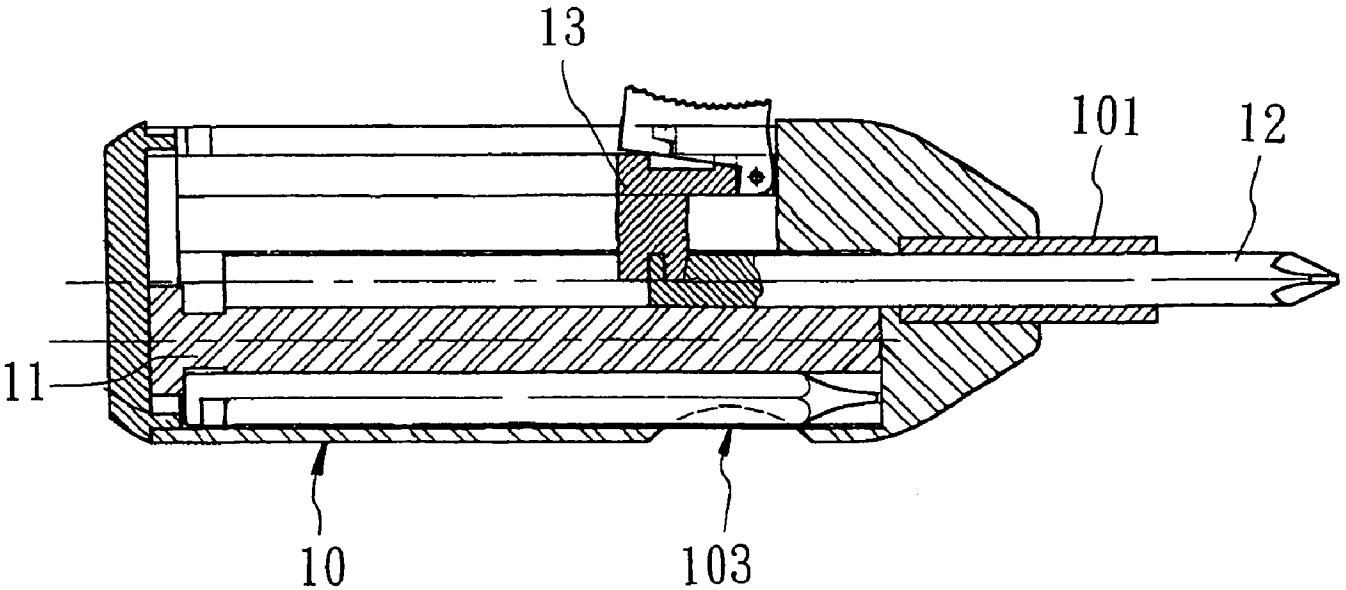
FIG. 3 PRIOR ART
FIG. 3 is a view similar to FIG. 2, where the shank has projected from the head by sliding the slide assembly.
Figure 4:
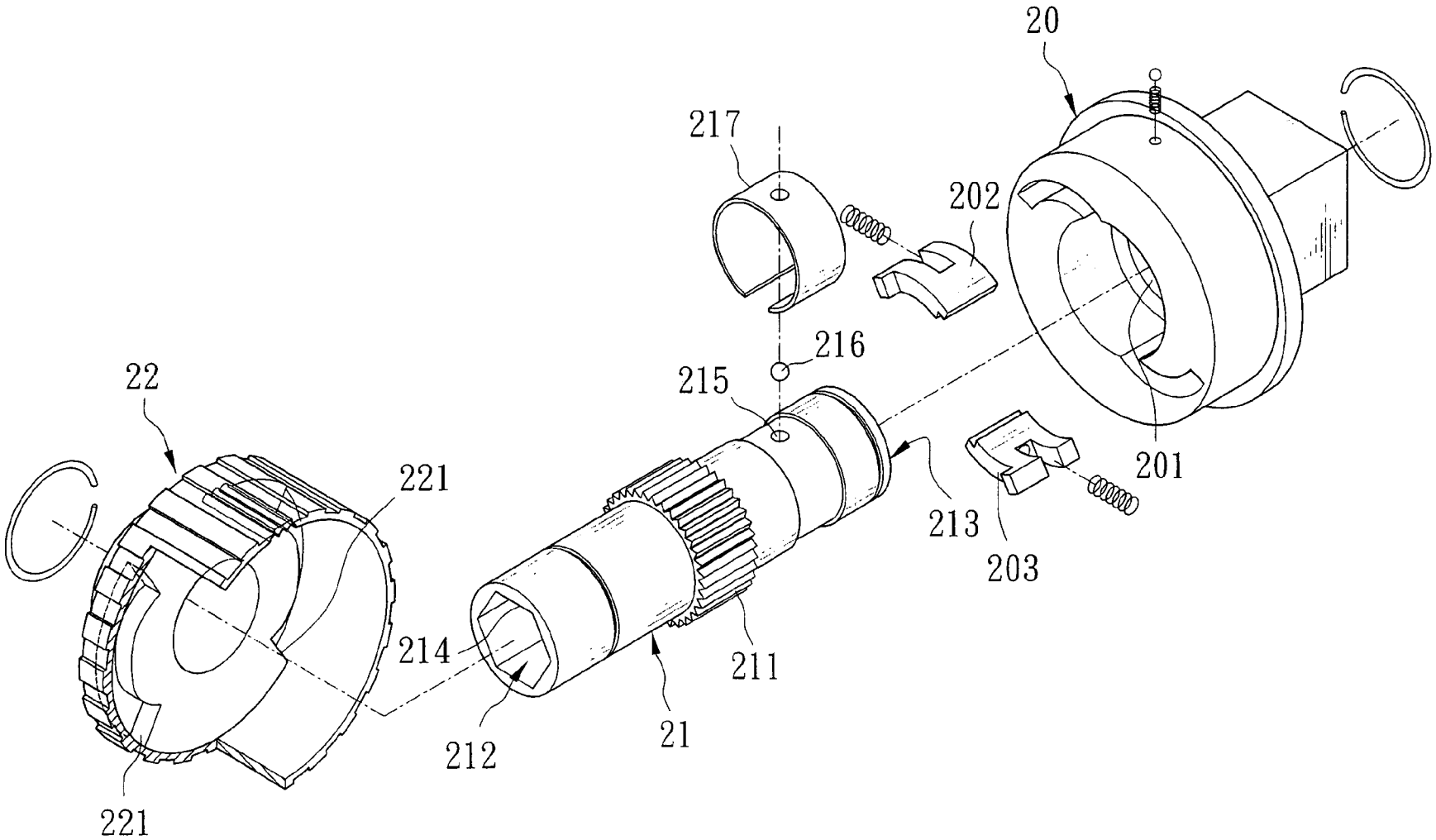
FIG. 4 is an exploded view of a ratchet device to be assembled with a revolving screwdriver according to the invention.
Figure 5:
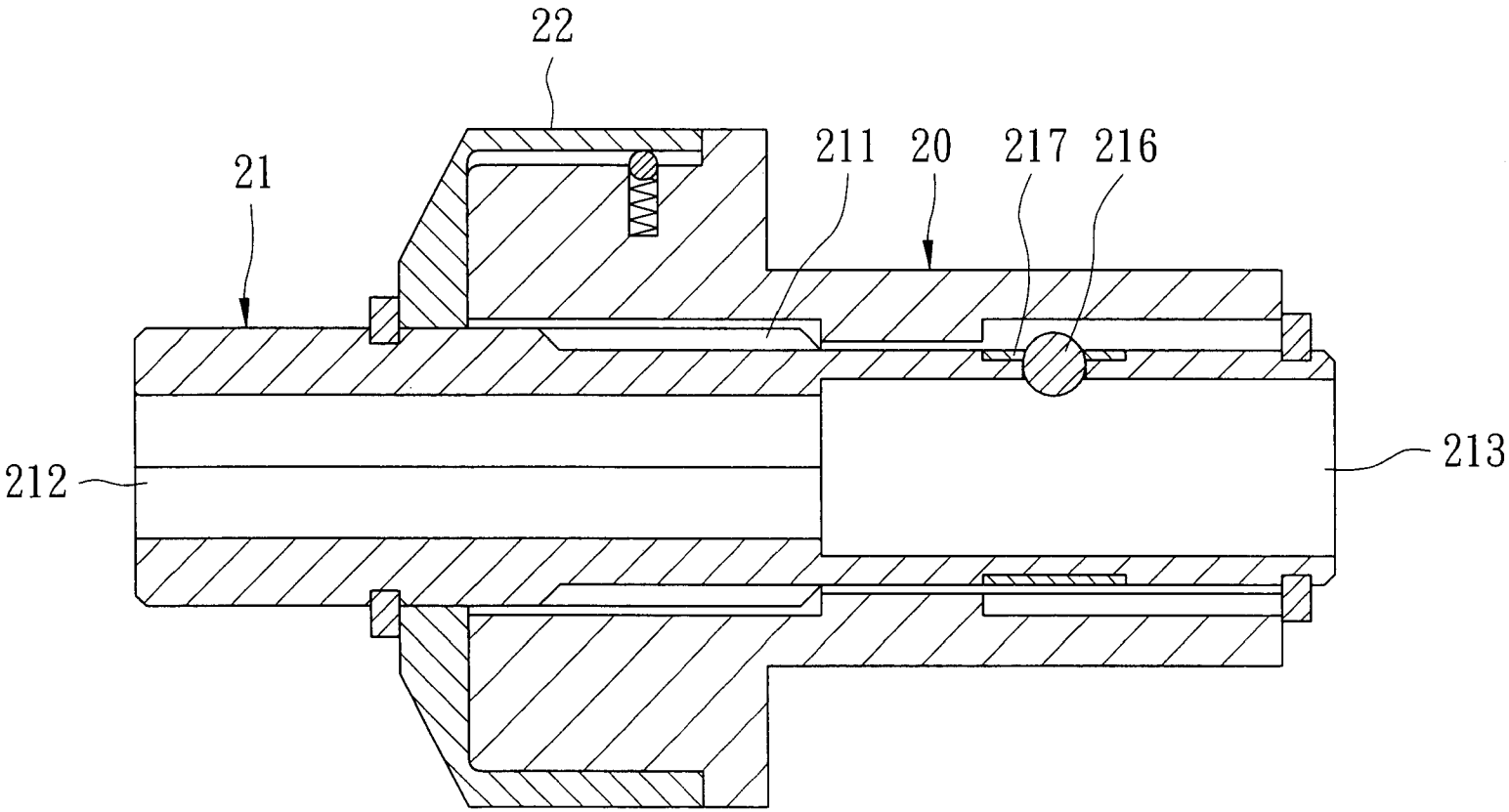
FIG. 5 is a sectional view of the assembled screwdriver of FIG. 4.
Figure 6:
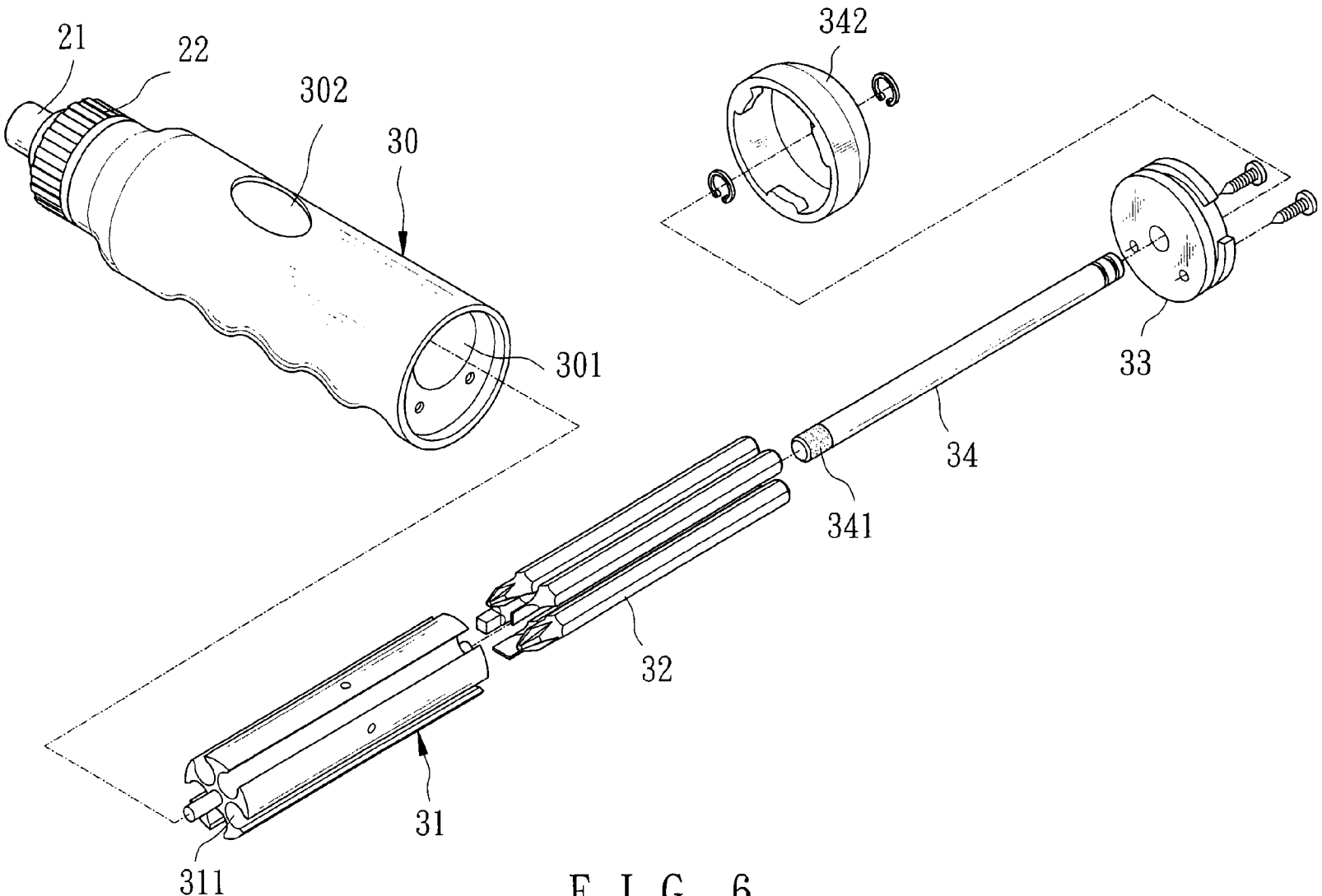
FIG. 6 is an exploded view of other components of the revolving screwdriver according to the invention to be assembled with the ratchet device of FIG. 5.
Figure 7:
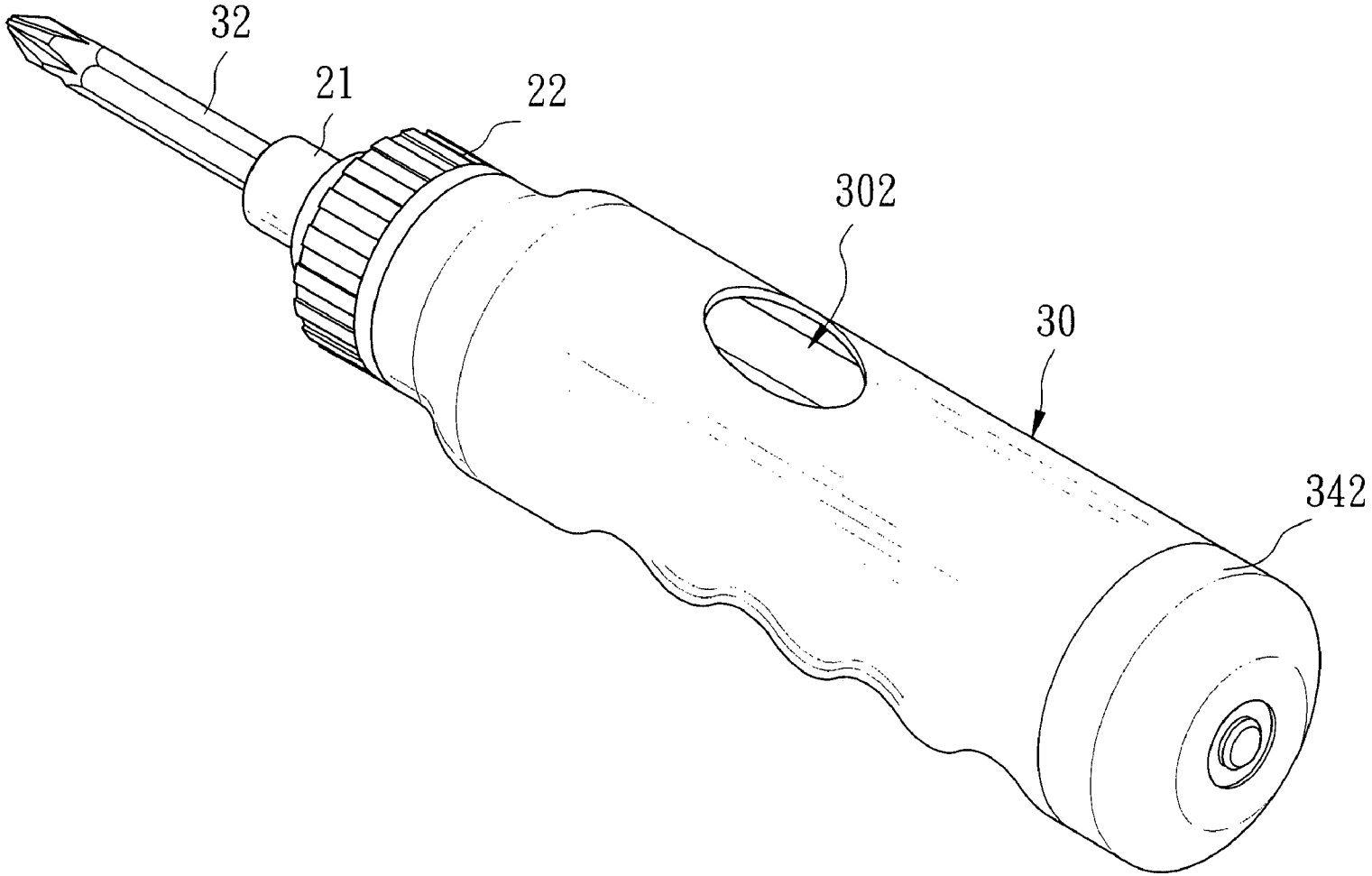
FIG. 7 is a perspective view of the assembled screwdriver according to the invention.

Referring to FIGS. 4 and 5, there is shown a revolving screwdriver constructed in accordance with a preferred embodiment of the invention comprising a ratchet device comprising seat 20, a ratchet shaft 21, and a knob 22. Each component will be described in detailed below.

The hollow seat 20 comprises an axial bore 201 for receiving the ratchet shaft 21, and two opposite spring depressible detents 202 and 203 each having a portion received in either wall groove 221 of the knob 22 such that a switching between the detents 202 and 203 by rotating the knob 22 will switch a rotation direction of the ratchet shaft 21. Note that control of the ratchet device is not the subject of the invention. Thus, a detailed description thereof is omitted herein for the sake of brevity.

The hollow ratchet shaft 21 comprises intermediate ratchet teeth 211 engaged with both detents 202 and 203, a front end 212 having a section of hexagon, a rear end 213 having a section of circle, and a guide in the rear end 213. The guide comprises an opening 215 formed on the seat 20, a C-shaped plate 217 having a central opening, and a ball 216 disposed in the opening 215, the ball 216 having a portion in the bore of the seat 20 and another portion projected from the opening of the plate 217 when the plate 217 is snugly put on a recessed, peripheral portion of the seat 20. As such, the guide is aligned with a flat surface 214 extended inwardly from the hexagonal front end 212. As an end, the ratchet shaft 21 is adapted to clockwise or counterclockwise rotate in the seat 20 by switching a rotation direction of the ratchet device.

Referring to FIGS. 6, 7, 8, and 9, the assembly of the ratchet device with other components of the revolving screwdriver for forming a complete revolving screwdriver will be described in detailed below. A hollow handle 30 comprises an eccentric bore 301 aligned with the rear end 213, an oval opening 302 on its surface to be in communication with the bore 301. A revolving cylinder 31 comprises a plurality of axial cartridges 311 having a section of C on its surface. Each cartridge 311 is capable of receiving one of a plurality of different shanks 32 (i.e., different tips including flat tip, Robertson tip, Phillips tip, etc.) having a section of hexagon. An abutment disk 33 has a front portion adapted to fasten in a rear end of the handle 30 (i.e., at the rear end of the bore 301) after mounting the revolving cylinder 31 in the bore 301. In use a user may put his/her finger in the opening 302 to contact the revolving cylinder 31 prior to rotating the revolving cylinder 31 in the bore 301. A spring depressible ball 303 in the handle 30 is adapted to enter one of a plurality of recesses of the revolving cylinder 31 for positioning by rotation (see FIG. 9). At this position, a desired shank 32 is aligned with the rear end 213. A push rod 34 is adapted to pass a central bore of the abutment disk 33. The push rod 34 comprises a front magnetic member 341. A cap 342 is adapted to fasten at a rear end of the push rod 34. A pushing of the cap 342 is adapted to push the push rod 34 into the cartridge 311 for moving the shank 32 (i.e., magnetically coupled to the magnetic member 341) out of the cartridge 311 into the rear end 213.

Figure 8:
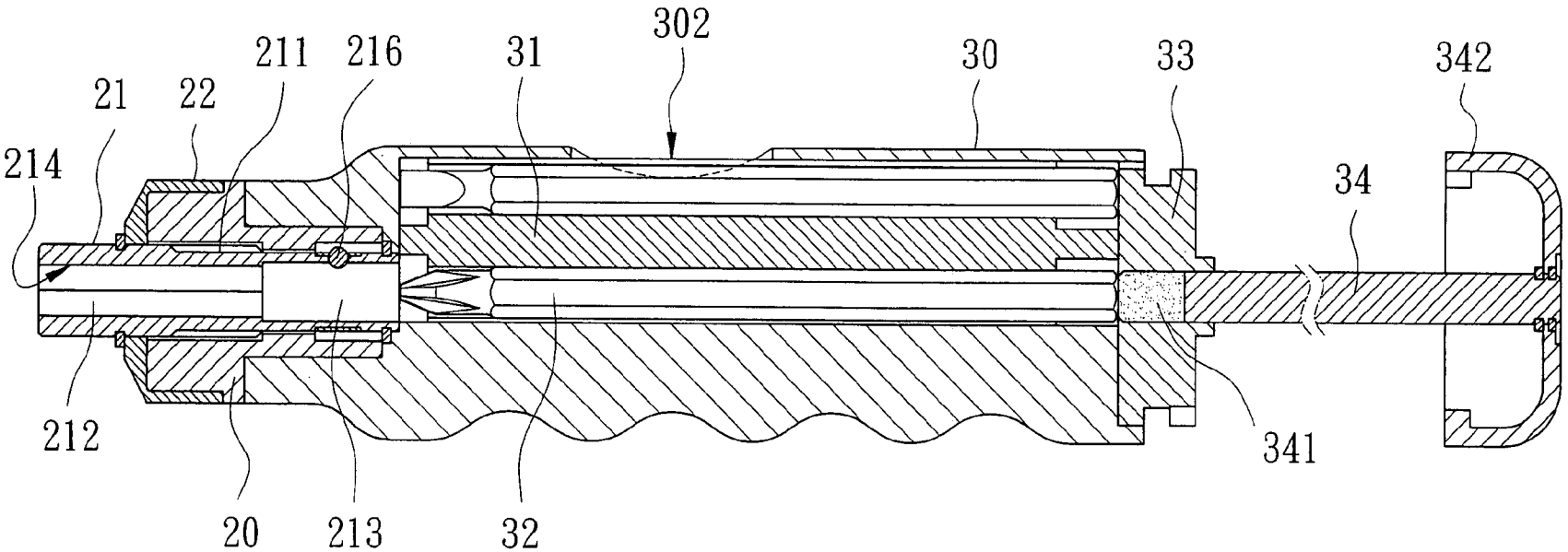
FIG. 8 is a sectional view of the screwdriver of FIG. 7, where one shank is aligned with the bore of the head prior to projecting therefrom for use.
Figure 9:
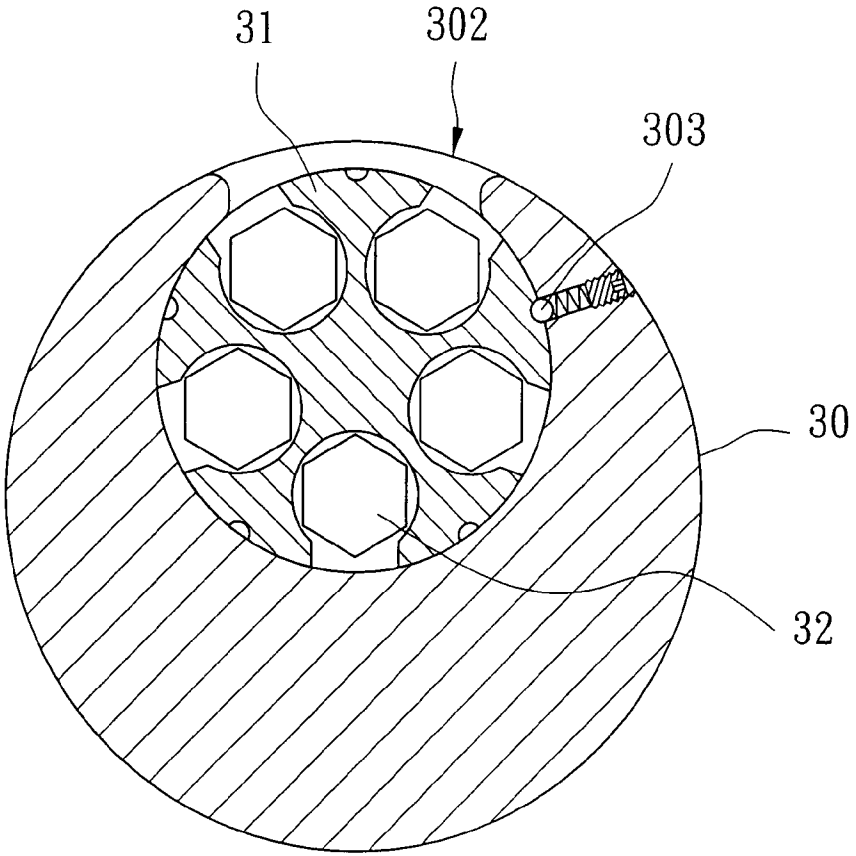
FIG. 9 is a sectional view of a handle showing shanks received in the cartridges of a revolving cylinder.
Figures 3, 10:
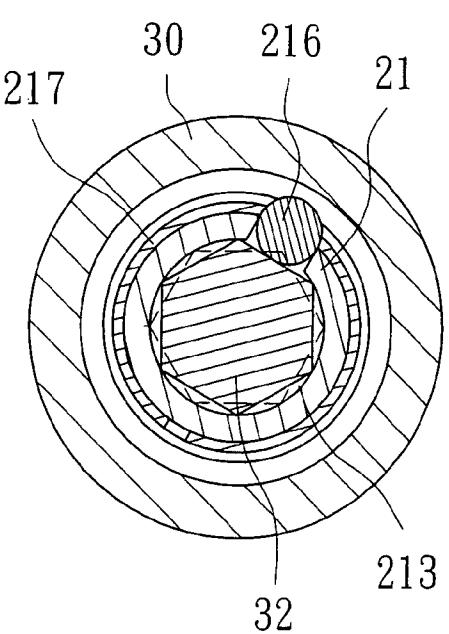
Figures 2, 10:
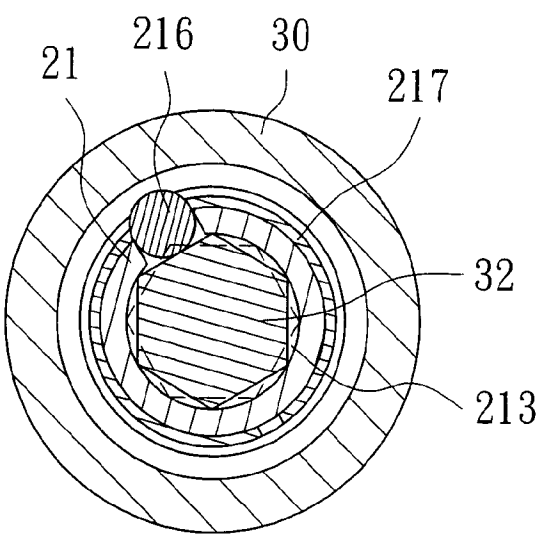
Figures 1, 10:
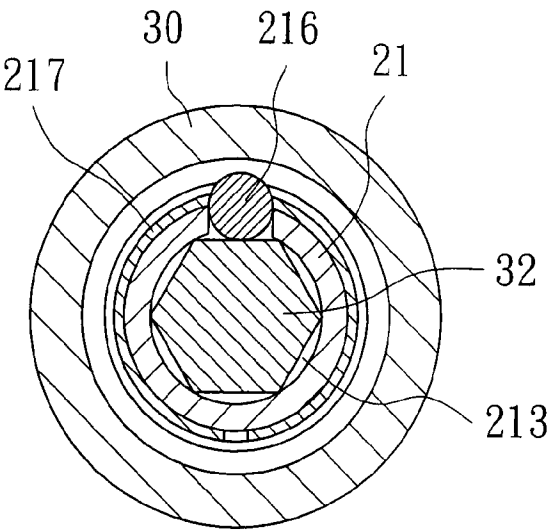

Referring to FIGS. 8 and 10, the orientation of the front end 212 (i.e., the hexagon thereof) may change since the ratchet shaft 21 is rotatable. In this regard, the shank 32 is required to align with the front end 212 by adjusting its orientation prior to moving thereinto. Advantageously, the provision of the guide can facilitate the adjustment of orientation as detailed below. In a case of both the ball 216 and the shank 32 rotated in a position aligned with the hexagon of the front end 212, the shank 32 is able to move into the front end 212 (see FIG. 10A). In another case of both the ball 216 and the shank 32 rotated in a position to the left of the handle 30 (i.e., not aligned with the hexagon of the front end 212), the elastic force exerted on the ball 216 may force both the ball 216 and the shank 32 to align with the hexagon of the front end 212. As an end, the shank 32 is able to move into the front end 212 (see FIG. 10B). In a further case of both the ball 216 and the shank 32 rotated in a position to the right of the handle 30 (i.e., not aligned with the hexagon of the front end 212), the elastic force exerted on the ball 216 may force both the ball 216 and the shank 32 to align with the hexagon of the front end 212. As an end, the shank 32 is able to move into the front end 212 (see FIG. 10C).

Figure 11:
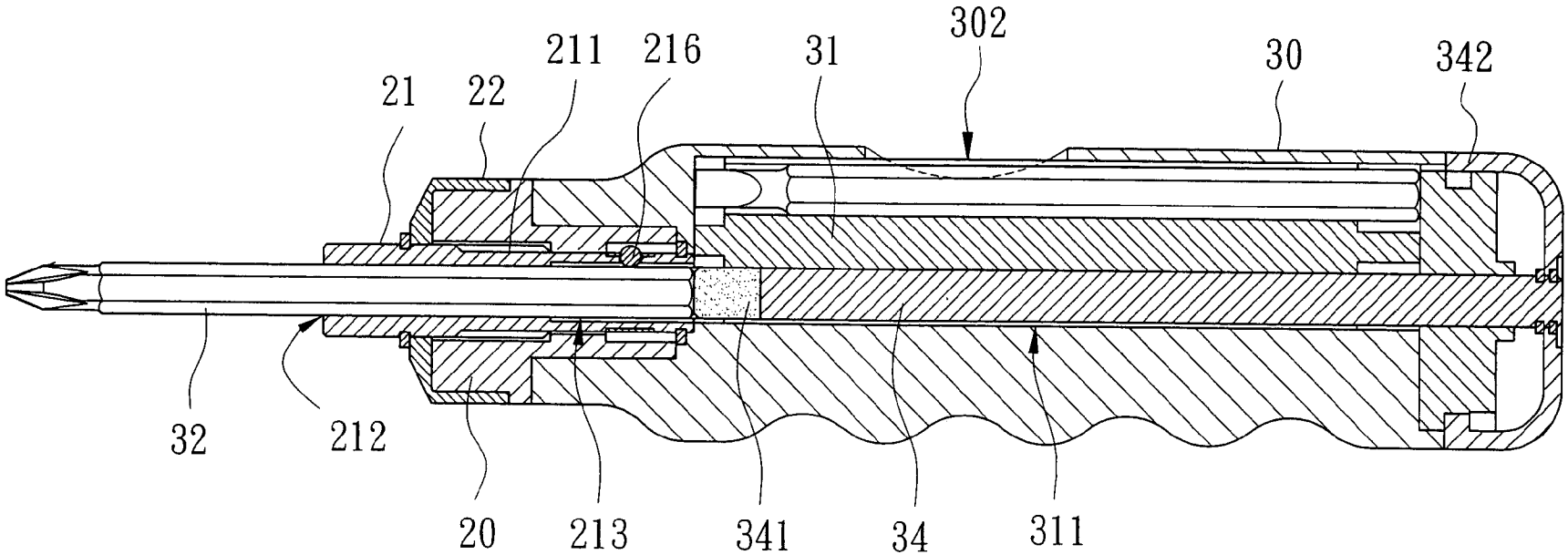
FIG. 11 is a view similar to FIG. 8, where the shank has projected from the ratchet shaft by pushing a push rod.
Figure 12:
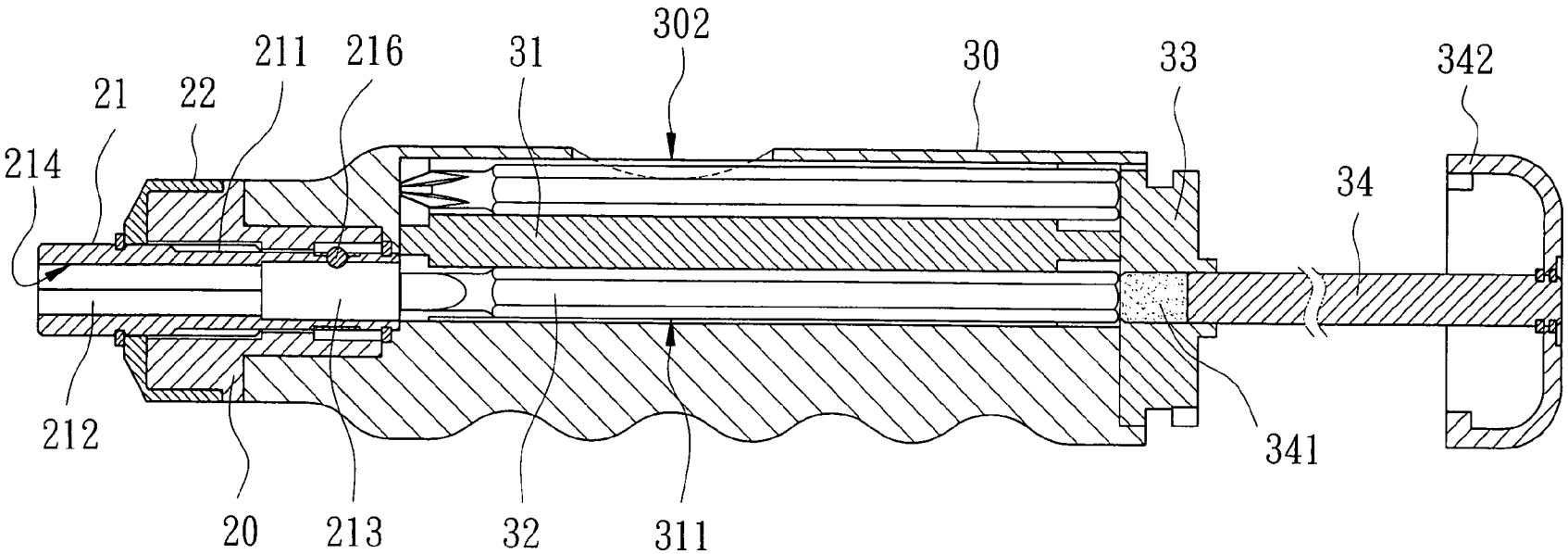
FIG. 12 is a view similar to FIG. 8 for illustration a shank change operation according to the invention.

Referring to FIGS. 11 and 12, the push rod 34 is adapted to push into the cartridge 311 for moving the shank 32 out of the cartridge 311 into the front end 212 through the rear end 212 irrespective of the rotation orientation of the ratchet shaft 21 due to the provision of the guide. As an end, the shank 32 projects from the ratchet shaft 21. At this position, the rear end of the shank 32 clears the cartridge 311 (i.e., in an operating position as shown in FIG. 11). For retracting the shank 32 into the cartridge 311, a user may pull the cap 342 rearwardly until the shank 32 is completely disposed in the cartridge 311. At this position, the front end of the shank 32 clears the ratchet shaft 21 (i.e., in a nonoperating position as shown in FIG. 12). As such, the user may rotate the revolving cylinder 31 for finding a desired shank 32.

Figure 13:
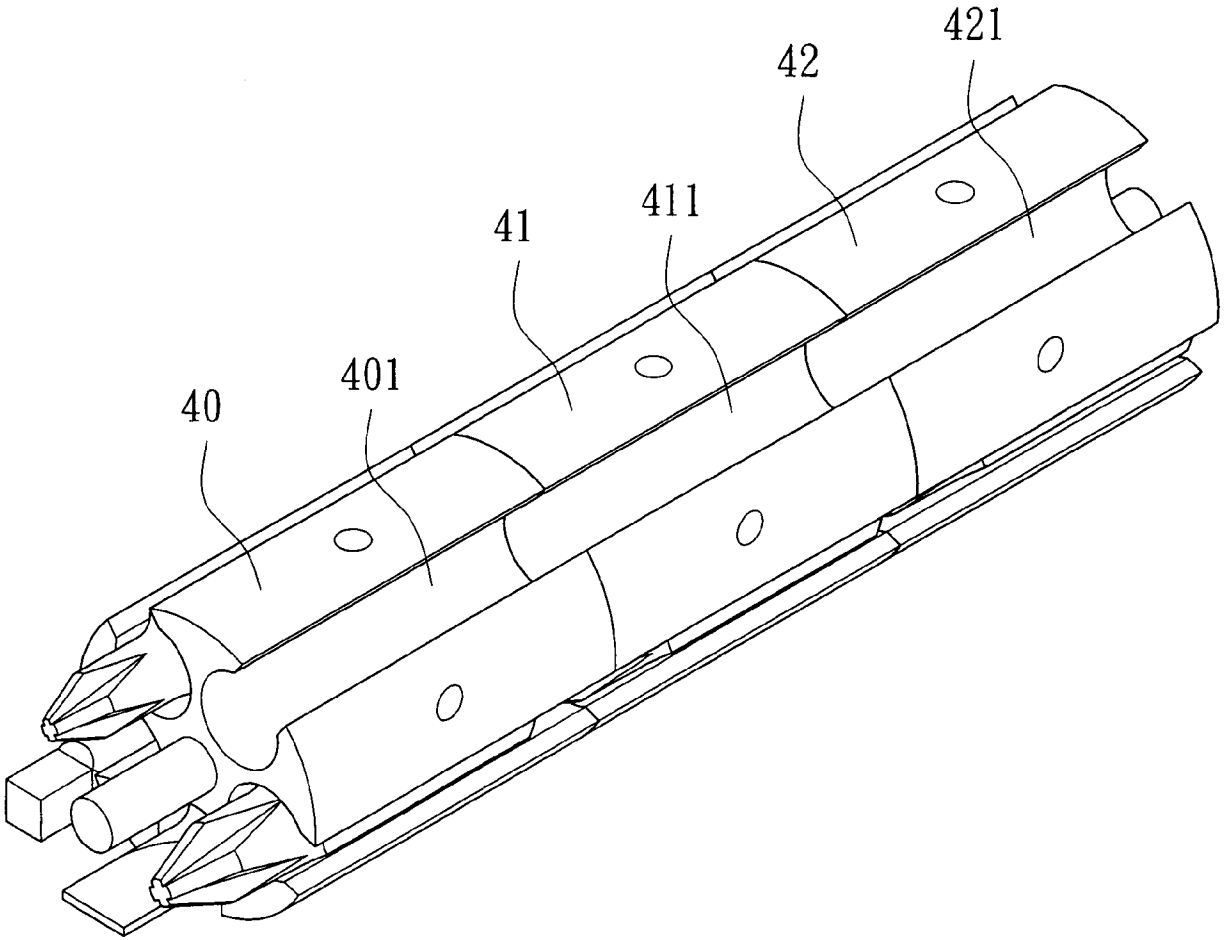
FIG. 13 is a perspective view of another preferred embodiment of revolving cylinder according to the invention.

Referring to FIG. 13, another preferred embodiment of revolving cylinder according to the invention is shown. The multistage revolving cylinder comprises a front segment 40 including a plurality of axial cartridges 401 having a section of C on its surface, an intermediate segment 41 including a plurality of axial cartridges 411 having a section of C on its surface, and a rear segment 42 including a plurality of axial cartridges 421 having a section of C on its surface. Likewise, each cartridge 401, 411 or 421 is capable of receiving one of a plurality of different shanks 32 (i.e., different tips including flat tip, Robertson tip, Phillips tip, etc.) having a section of hexagon. Also, a straight channel is formed by aligning the cartridges 401, 411, and 421 together.

Figures 1, 14:
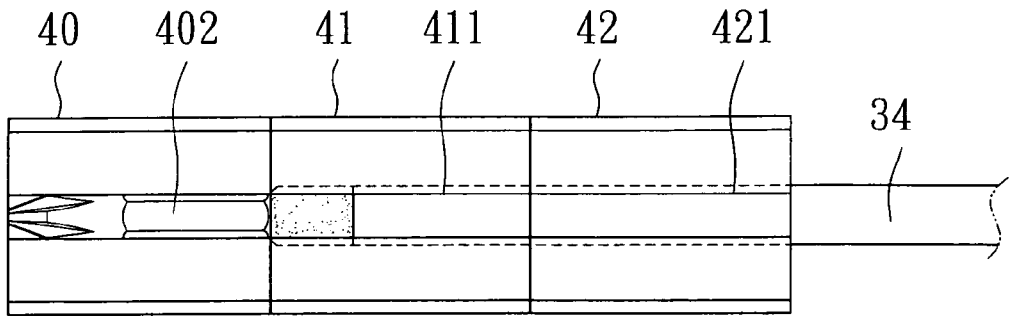
Figures 2, 14:
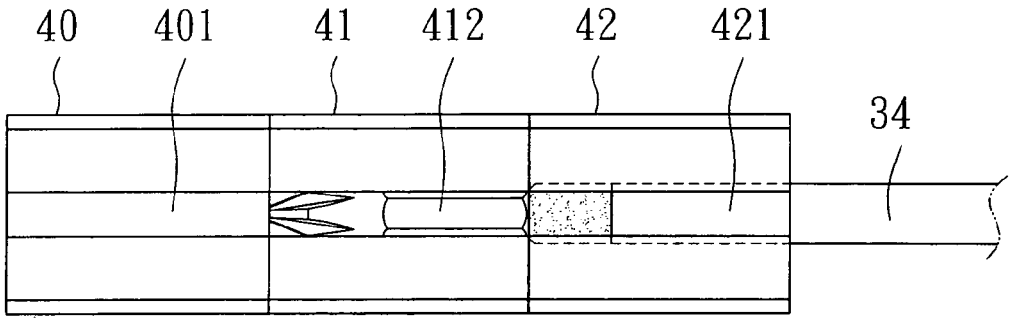
Figures 3, 14:
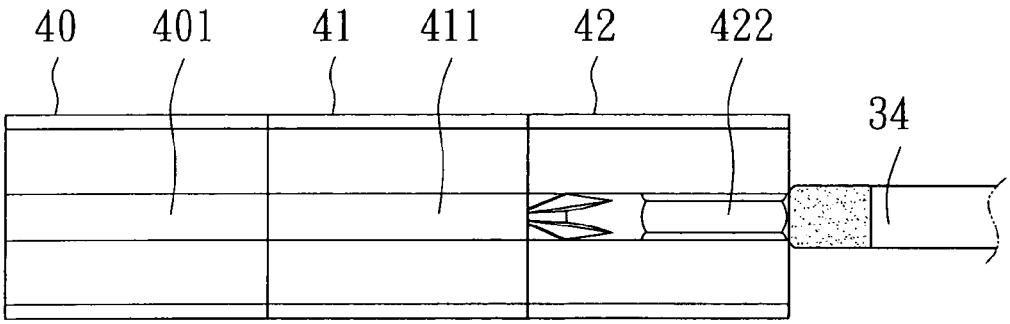

Referring to FIG. 14A, for using the shank 402 in the front segment 40 a user may rotate the intermediate and rear segments 41 and 42 until the cartridges 411 and 421 are aligned with the push rod 34. Next, push the push rod 34 through the cartridges 421 and 411 to contact the shank 402 prior to pushing the shank 402 out of the head of the ratchet shaft 21. Referring to FIG. 14B, likewise for using the shank 412 in the intermediate segment 41 a user may rotate the front and rear segments 40 and 42 until the cartridges 401 and 421 are aligned with the push rod 34. Next, push the push rod 34 through the cartridge 421 to contact the shank 402 prior to pushing the shank 402 out of the cartridge 401 and the head of the ratchet shaft 21 sequentially. Referring to FIG. 14C, also likewise for using the shank 422 in the rear segment 42 a user may rotate the front and intermediate segments 40 and 41 until the cartridges 401 and 411 are aligned with the push rod 34. Next, push the push rod 34 to contact the shank 402 prior to pushing the shank 402 out of the cartridges 411 and 401 and the head of the ratchet shaft 21 sequentially.

Figure 15:
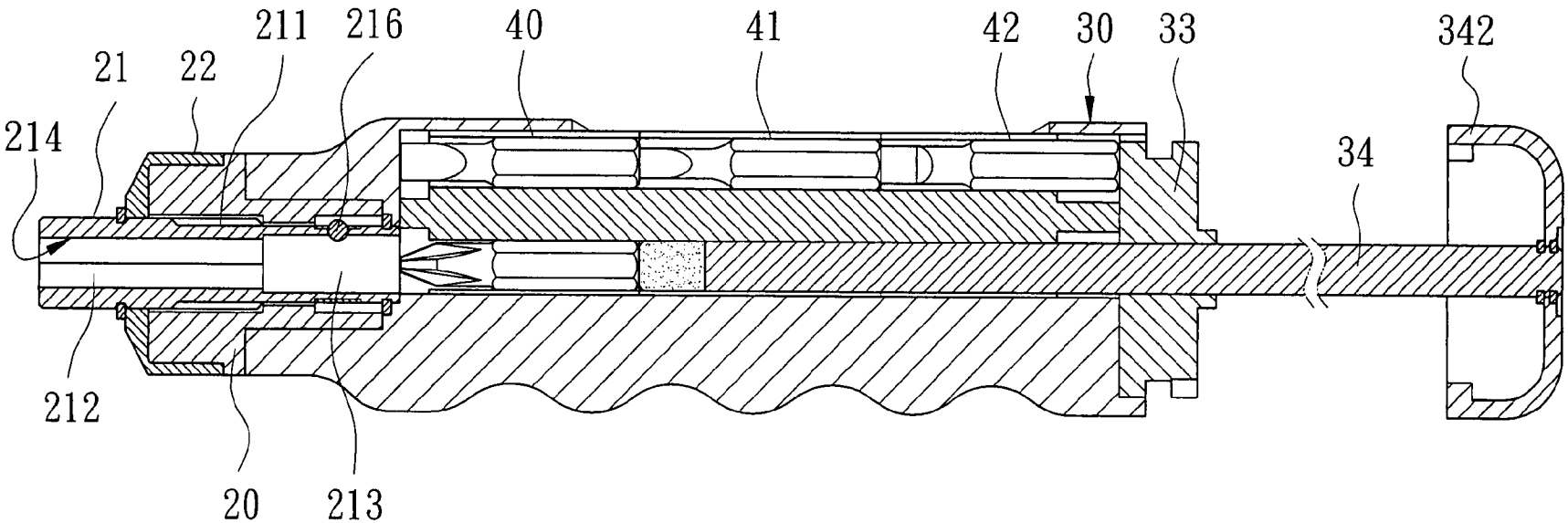
FIG. 15 is a sectional view of the screwdriver, where one shank stored in the revolving cylinder of FIG. 13 is aligned with the bore of the ratchet shaft prior to projecting therefrom.

Referring to FIG. 15, the front, intermediate and rear segments 40, 41 and 42 are adapted to form a complete revolving cylinder to be mounted in a revolving screwdriver so that a user can have more shank choice.

While the invention herein disclosed has been described by means of specific embodiments, numerous modifications and variations could be made thereto by those skilled in the art without departing from the scope and spirit of the invention set forth in the claims.

What is claimed is:

1. A revolving screwdriver comprising:

a forward ratchet device comprising a hollow, cylindrical seat and a ratchet shaft; and a hollow handle comprising a revolving cylinder including a plurality of axial, peripheral cartridges for receiving a plurality of hexagonal shanks having different tips, and a push rod adapted to push the shank out of the cartridge into the ratchet shaft;

wherein the ratchet shaft is hollow and comprises a front end having a hexagonal cross-section, a rear end having circular cross-section, and a guide in the rear end thereof, the guide being aligned with a flat surface extended inwardly from the hexagonal front end of the ratchet shaft such that it automatically aligns one shank pushed out of the ratchet cylinder with the forward end of the ratchet shaft prior to pushing the shank out of the ratchet shaft for use;

further wherein the guide comprises a first opening formed on the seat, a C-shaped plate having a central opening, and a ball disposed in the first opening, the ball having a first portion disposed in the seat and a second portion projected from the central opening when the plate is put on the seat.

2. The revolving screwdriver of claim 1, wherein the handle comprises a second opening on its surface to be in communication with the revolving cylinder so as to allow a person to put a finger in the second opening to contact the revolving cylinder prior to rotating the revolving cylinder.

3. The revolving screwdriver of claim 1, wherein the handle further comprises a spring depressible ball adapted to positioning on the revolving cylinder such that rotating the revolving cylinder will align one of the shanks with the rear end of the ratchet shaft.

4. The revolving screwdriver of claim 1, wherein the push rod comprises a front magnetic member for magnetically coupling to the shank prior to moving together.

5. The revolving screwdriver of claim 1, wherein the revolving cylinder comprises a plurality of stages each including a plurality of axial, peripheral cartridges for receiving the plurality of hexagonal shanks having different tips, and wherein each cartridge of one stage is adapted to align with the cartridges of the other stages to form a straight channel.

* * * * *